United States Patent [19]

Greenawalt

[11] Patent Number: 4,694,590

[45] Date of Patent: Sep. 22, 1987

[54] ARCH SUPPORT UNIT AND METHOD OF FORMATION

[76] Inventor: Kent S. Greenawalt, 1100 Mela Dr., Dubuque, Iowa 52001

[21] Appl. No.: 847,679

[22] Filed: Apr. 3, 1986

[51] Int. Cl.[4] ..... A43B 7/22

[52] U.S. Cl. ..... 36/91; 36/43; 36/44; 36/71; 128/604

[58] Field of Search ..... 36/91, 88, 43, 10, 71, 36/44, 100, 101; 2/DIG. 6, 245; 128/581, 586, 602, 604

[56] References Cited

U.S. PATENT DOCUMENTS

| | | | |
|---|---|---|---|
| 1,583,274 | 5/1926 | Bostock | 36/100 |
| 1,907,995 | 5/1933 | Nickerson | 128/604 |
| 2,586,057 | 2/1952 | Knellwolf | 36/71 X |
| 2,865,097 | 12/1958 | Vollrath, Jr. et al. | 36/43 |
| 2,958,925 | 9/1960 | Held | 2/DIG. 6 |
| 3,470,880 | 10/1969 | Pagliano | 36/71 X |
| 3,596,291 | 8/1971 | Thill | 2/245 |
| 3,870,145 | 3/1975 | Mizuno | 206/460 X |
| 3,999,311 | 12/1976 | Epstein | 36/100 |
| 4,279,083 | 7/1981 | Dilg | 36/101 |
| 4,316,333 | 2/1982 | Rothschild | 36/91 X |

*Primary Examiner*—Stephen Marcus
*Assistant Examiner*—T. Graveline
*Attorney, Agent, or Firm*—Henderson & Sturm

[57] ABSTRACT

An arch support unit (10) and a method of forming same for use with a shoe (11) having an inner sole (18) for receiving a person's foot, the unit (10) comprising a flexible support (19) to which is added a first pad (31) adhered to the heel area of the sole (18), the first pad (31) having an exposed first portion (34) of Velcro material, and a second pad (31) having on one side a second mating portion (41) of Velcro for releasable locking engagement with the first portion (34), and the second pad (32) having on the other side an adhesive material (42) adapted when exposed to releasably adhere to the shoe inner sole (18).

1 Claim, 6 Drawing Figures

ARCH SUPPORT UNIT AND METHOD OF FORMATION

TECHNICAL FIELD

The present invention relates generally to arch supports, and more particularly to arch supports and a method of formation thereof adapted for secure but removable attachment to shoes, particularly women's dress shoes.

BACKGROUND ART

Arch supports, whether pre-manufactured for mass purchase and use or customized for individual use are known in this art. Their use with dress shoes has been severely limited if not negated, however, due to there being no known manner or method of holding the support to the inner sole of the shoe other than conventional means; such as conforming the outline of the support to that of the shoe, and/or providing a roughened bottom surface for the support which will hold to the shoe inner sole.

Under normal use of a conventional arch support, the support will not properly hold in place in a woman's dress shoe due to the elevation of the heel of the shoe. Thus, although many women needed arch supports at all times, they were limited to their use primarily with more casual or sports type shoes.

DISCLOSURE OF THE INVENTION

The above problems are substantially resolved, without undue compromise of other desirable attributes that are already provided by prior art devices, by the provision of the invention disclosed herein.

The present invention relates generally to arch supports and more particularly to arch supports and a method of formation thereof adapted to secure but still readily removable attachment to shoes, and for more particular use with shoes having an elevated heel.

The arch support unit of this invention comprises an arch support having a circular opening formed in a portion thereof at the heel end to receive and permanently hold a first element having an exposed surface of, for example, the "hook" portions of Velcro; and a second element of like size and shape as the first element, which second element has on one side, for example, the "loop" portions of Velcro for releasable locking engagement with the "hook" portions, and on the other side an adhesive material for adhering engagement with the inner sole of the shoe.

In use, the second element is "locked" to the first element, and where the support is placed within the shoe at the proper location therein, the support remains in place during use. The support may be easily removed, the first and second element separating and with the second element remaining in place. By using another second element, attaching it to the first element and exposing it adhesive surface, the support can then be used in another, different shoe. Thus, a universal arch support and a method of forming it and applying it to any style and type of shoe are provided.

BRIEF DESCRIPTION OF THE DRAWINGS

These and other attributes of the invention will become more clear upon a thorough study and review of the following detailed description of the best mode for carrying out the invention, particularly when reviewed in conjunction with the drawings, wherein.

BEST MODE FOR CARRYING OUT THE INVENTION

Figure 1:
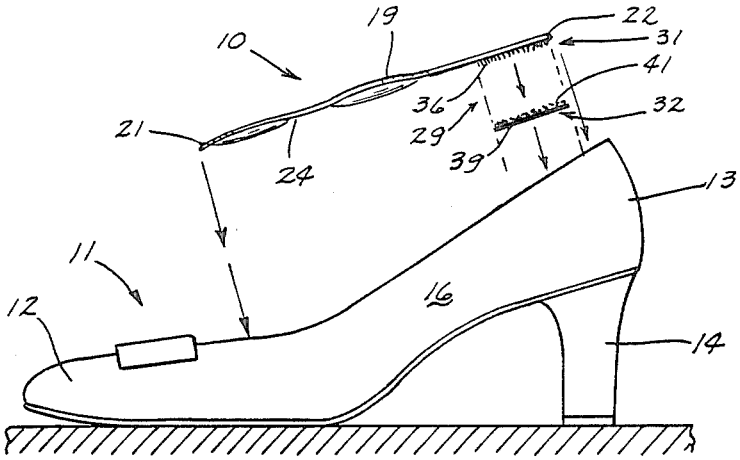
FIG. 1 comprises a side elevation of a woman's dress shoe and a partially exploded view of the arch support unit of this invention.

Referring now to the drawings, and particularly to FIG. 1, the arch support unit of this invention is indicated generally at (10), and is adapted particularly for use with a woman's dress shoe (11), although not limited thereto. The shoe (11) is a conventional dress shoe and includes a toe portion (12), a heel portion (13), a heel support (14) preferably of not more than two inches (2"), sides (16), an opening (17) for receiving a person's foot (not shown), and an inner sole (18) on which the arch support unit (10) is placed.

The unit (10) comprises an arch support (19) having a toe portion (21) (FIG. 3) and a heel portion (22). The support (19) includes a relatively thin piece (23) of leather having an outline which may be determined by a custom analysis of the arch support needs of a person, and which further is compatible with the size and shape of the particular shoe (11) involved. The normally exposed, upper surface (23*a*) of the piece (23) is smooth so as to effectively receive conventional stockings and the like of the foot of the user. The support (19) further includes an even thinner second piece (24) (FIG. 5) of leather adhered at (30) to the side of the first piece (23) opposite the smooth surface (23*a*) side thereof. The exposed surface, normally bottom, of the second piece (24) is relatively rough.

Figure 3:
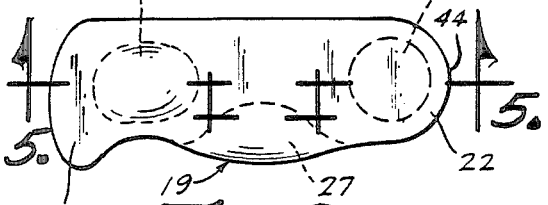
FIG. 3 is a plan view only of the arch support unit.
Figure 4:
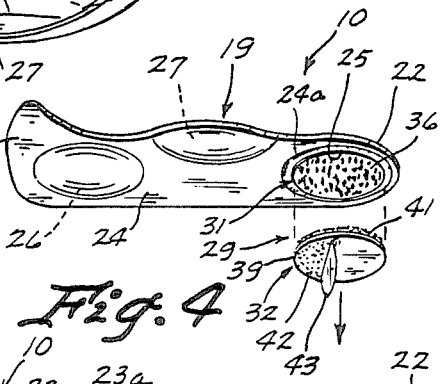
FIG. 4 is a view of the underside of the support showing in exploded view a second element thereof.
Figure 5:
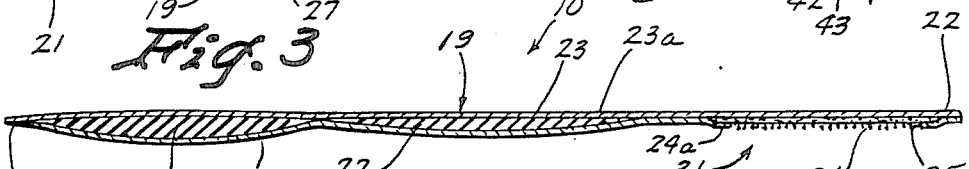
FIG. 5 is an enlarged sectional view taken along 5—5 in FIG. 3.

In between the pieces (23) and (24) are formed and secured several resilient elements (26) and (27) (FIGS. 3 and 5). The exact placement and formation of these elements (26) and (27) are determined by the custom analysis of the particular foot and arch support needs of the user of the support (10) referred to hereinbefore and are not a part of this invention. In the heel portion of the second piece (24), a circular opening (25) (FIG. 4) is formed for a purpose described hereinafter.

Figure 2:
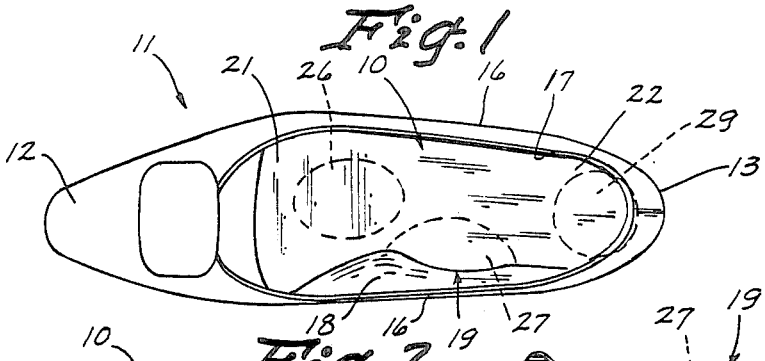
FIG. 2 is a plan elevational view of the dress shoe and arch support unit of FIG. 1 in assembled relation.
Figure 6:
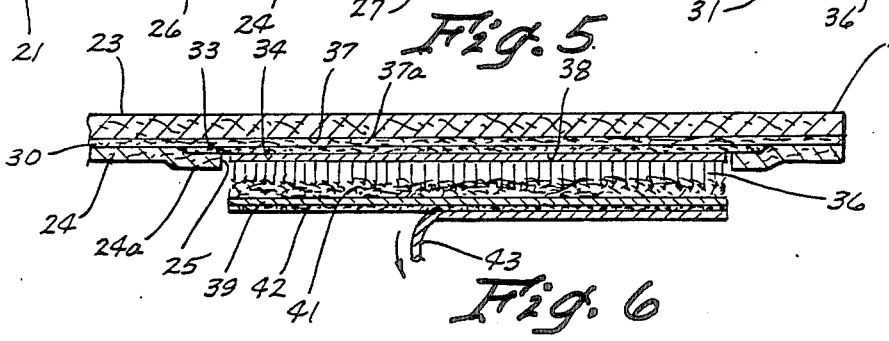
FIG. 6 is a further enlarged sectional view showing the support, first and second elements in full assembled relation.

The unit (10) comprises further a fastener device indicated generally at (29) and which includes a first circular pad (31) adapted to be fastened to the underside of the support (19) as shown in FIGS. 4–6; and a second circular pad (32) separate from the first pad (31) and adapted to be releasably locked thereto, and adapted further to adheringly engage the inner sole (18) of the shoe (11) as shown in FIG. 2.

The first pad (31) comprises a relative stiff, thin circular first element (33) (FIG. 6) having a diameter larger than the diameter of the circular opening (25) of the second piece (24), and a circular part (34) of Velcro "hook" material (36) affixed to the element (33), which part (34) has a diameter equal to that of the opening (25) and with the "hook" material (36) exposed. Referring to FIGS. 4 and 6 particularly, the first element (33) is secured to the support (19) by adhesive (37*a*) between the bottom surface (37) of the leather piece (23), and the "hook" portion secured to the bottom surface (38) of the first element (33). Due to the diameter of the first element (33) being larger than the opening (25), the periphery (24*a*) (FIG. 6) of the lower, second piece (24) will overlap the periphery of the first element (33), with only the "hook" material (36) exposed (FIG. 4).

The element (33) is of a rigid, fiberboard-type material which aids in preventing the curling up of the heel area of the arch support (10), thereby enhancing the capability of the improved support (10) to be positioned properly within the shoe as set forth herein.

The second pad (32) comprises a circular "loop" portion (41) of Velcro material of the same diameter as the "hook" portion (36) with a backing of adhesive material (42) covered by a layer of waxed paper (43) or the like which is easily removable to expose the adhesive (42).

In use, one peels off the protective paper (43) and then places an index finger on the sticky adhesive material (42) of the second pad (32). Holding the support (19) in the other hand, the "loop" portion (41) is then pressed against the "hook" portion (36) whereby they interlock such that the index finger may then be removed, leaving the second pad (32) releasably locked to the first pad (31).

The support (19) is then slid down inside the heel (13) of the shoe (11), with the rear edge (44) of the support (19) as close as possible to the rear of the inside sole (18) of the shoe (11). The arch support (19) is then pressed firmly down against the sole (18) and particularly at the area of the fastener device (29) such that the second pad (32) firmly adheres with the shoe inner sole (18). The same operation is of course repeated with the other mate to the shoe (11) such that both shoes with the unique arch supports (10) are in place and ready for wear.

As mentioned hereinbefore, the arch support units (10) are usable with all types of shoes, and although individually customized supports (19) are illustrated, the fastener device (29) per se may be used advantageously with any conventional arch support by fastening the first pad (31) to the underside of the support by any known means, with the remainder of the method of forming and attaching the fastening device being quite similar to that described herein.

Of importance, the user of the arch support unit (10) may desire to remove the unit (10) from the shoe (11) and use it again in another shoe. Removal of the unit (10) is effected by lifting the support (19) out of the shoe (11). As the bond of the adhesive (42) is greater than the interlock of the Velcro material (34) and (41), the materials (34) and (41) separate with the second pad (32) remaining adhered to the shoe inner sole (18). It is recommended that an extra second pad (not shown) identical to pad (32) be provided for other use of the support (19); for example, the pressure adhesive paper (43) may be an elongated strip of such paper (not shown) to which a plurality of separate, circular "loop" portions (41) with adhesive bottom surfaces (42) are removably secured. Thus, each time the support (19) is removed from one shoe and used in another shoe, a new second pad (32) is available. The "used" second pad (32) may be easily removed from the inner sole (18) as desired by the user by merely being pulled away therefrom, re-use being possible but not recommended.

Although a leather-type arch support (10) has been disclosed in this particular embodiment, it is to be noted that the fastener (29) may be used with non-leather, or rigid and semi-rigid arch supports of different material, such as plastic. In those instances, the provision of the element (33) is obviated, leaving the Velcro-type part (34) to be adhered as by (37*a*) to the bottom of the more rigid arch support.

Obviously, may modifications and variations of the present invention are possible in light of the above teachings. It is therefore to be understood that, within the scope of the appended claims, the invention may be practiced otherwise than as specifically described therein.

I claim:

1. A separable fastener device adapted for use in securing a removable arch support to an internal portion of a shoe comprising:

first and second pads, said first pad comprising a circular, rigid planar element, with a second pad comprising a circular planar second element;

means applied to one side of said first element for attaching said first element to said removable arch support;

surface bearing pressure responsive adhesive means applied to one side of said second element for attaching said second element to said internal portion of said shoe; and means attached to each of the other sides of said first and second elements providing releasable interengagable mating surfaces on said other sides wherein said mating surfaces engage upon pressing together said surfaces and release upon pulling said surfaces apart;

and further wherein a portion of the arch support is cut away and with an outer edge of said first element inserted within said cut away area such that the periphery of the arch support about said cut away area overlaps said first element outer edge.

* * * * *